United States Patent [19]

Kawai

[11] 4,329,969

[45] May 18, 1982

[54] DIRECT AIR COOLING DEVICE FOR THE COMBUSTION CHAMBER OF THE INTERNAL COMBUSTION ENGINE IN AN AUTOMOBILE

[76] Inventor: Mitsuji Kawai, No. 27 1-chome Kaname-cho, Toshima-ku, Tokyo, Japan

[21] Appl. No.: 127,773

[22] Filed: Mar. 6, 1980

[30] Foreign Application Priority Data

Mar. 19, 1979 [JP] Japan ..... 54-31202

[51] Int. Cl.[3] ..... F02N 23/04

[52] U.S. Cl. ..... 123/585; 261/63

[58] Field of Search ..... 123/586, 585, 588, 589; 261/63

[56] References Cited

U.S. PATENT DOCUMENTS

| | | | |
|---|---|---|---|
| 1,360,547 | 11/1920 | Loetscher | 123/585 |
| 2,886,020 | 5/1959 | Wolfe | 123/585 |
| 3,626,915 | 12/1971 | Nakajima | 123/585 |
| 3,661,368 | 5/1972 | Metivier | 261/63 |
| 3,961,615 | 6/1976 | Poslek | 123/586 |
| 4,197,823 | 4/1980 | Schwartz | 123/588 |
| 4,211,197 | 7/1980 | Kawai | 123/585 |

*Primary Examiner*—Ronald H. Lazarus

*Attorney, Agent, or Firm*—Irving M. Weiner; Pamela S. Burt; John L. Shortley

[57] ABSTRACT

A direct air cooling device for the combustion chamber of the internal combustion engine in an automobile in which an external air suction port member is provided in a path connecting between the carburetor and cylinder in the internal combustion engine and a valve plate is provided adjacent to the suction port member for slidable movement relative to the air suction port member to close and open the port member.

3 Claims, 3 Drawing Figures

DIRECT AIR COOLING DEVICE FOR THE COMBUSTION CHAMBER OF THE INTERNAL COMBUSTION ENGINE IN AN AUTOMOBILE

BACKGROUND OF THE INVENTION

This invention relates to an air cooling device for the combustion chamber of the internal combustion engine in an automobile and, more particularly, to a direct air cooling device for the combustion chamber of the internal combustion engine in an automobile which is adapted to very effectively cool the interior of the combustion chamber by feeding external air to the combustion chamber directly.

In an automobile, it has been known that when the engine brake is engaged by closing the throttle valve in order to reduce the driving speed of the automobile, since a substantial negative pressure is generated, the fuel is forcibly drawn off the slow nozzle to remove the oil film from the nozzle under the action of the negative pressure. However, such draw of the fuel under the action of the negative pressure becomes a main cause of blow-by.

In order to eliminate the disadvantage of such blow-by, there has been proposed an air cooling device for the combustion chamber of the internal combustion engine in an automobile. Such an air cooling device generally comprises an external air suction port member formed of a magnetically attractive material or magnet provided in a passage connecting between the carburetor and cylinder, and a valve member formed of a magnet or a magnetically attractive material and magnetically attracted about the air suction port member for slidable movement about the port member against the magnetically attractive force when the port member is opened. The device is the subject of Japanese patent application No. 157,769/1978.

SUMMARY OF THE INVENTION

The present invention provides a novel and improved direct air cooling device of the type as shown and described in the above-mentioned Japanese patent application.

According to the present invention, the external air suction port member of a magnetically attractive material or magnet and the valve formed of a magnet or magnetically attractive material in the device of the above-mentioned Japanese patent application are replaced by a non-magnetic air suction port member and a non-magnetic valve plate to thereby reduce the material cost of these parts. With the air suction port member and valve plate being formed of a non-magnetic material, the direct air cooling device of the present invention can effectively eliminate the disadvantage such as blow-by inherent in the prior art air cooling devices for internal combustion engine combustion chambers in automobiles and at the same time save fuel cost by causing the combustion chamber to directly suck a substantial amount of external air therein when the automobile is reduced in its driving speed, and to rapidly cool the combustion chamber without supplying fuel into the combustion chamber.

The above and other objects and attendant advantages of the present invention will be more readily apparent to those skilled in the art from a reading of the following detailed description in conjunction with the accompanying drawings which show one preferred embodiment of device of the present invention for illustration purposes only, but not for limiting the scope of the same in any way.

BRIEF DESCRIPTION OF THE INVENTION

PREFERRED EMBODIMENT OF THE INVENTION

The present invention will now be described with reference to the accompanying drawings which show one preferred embodiment of direct air cooling device of the invention.

Figure 1:
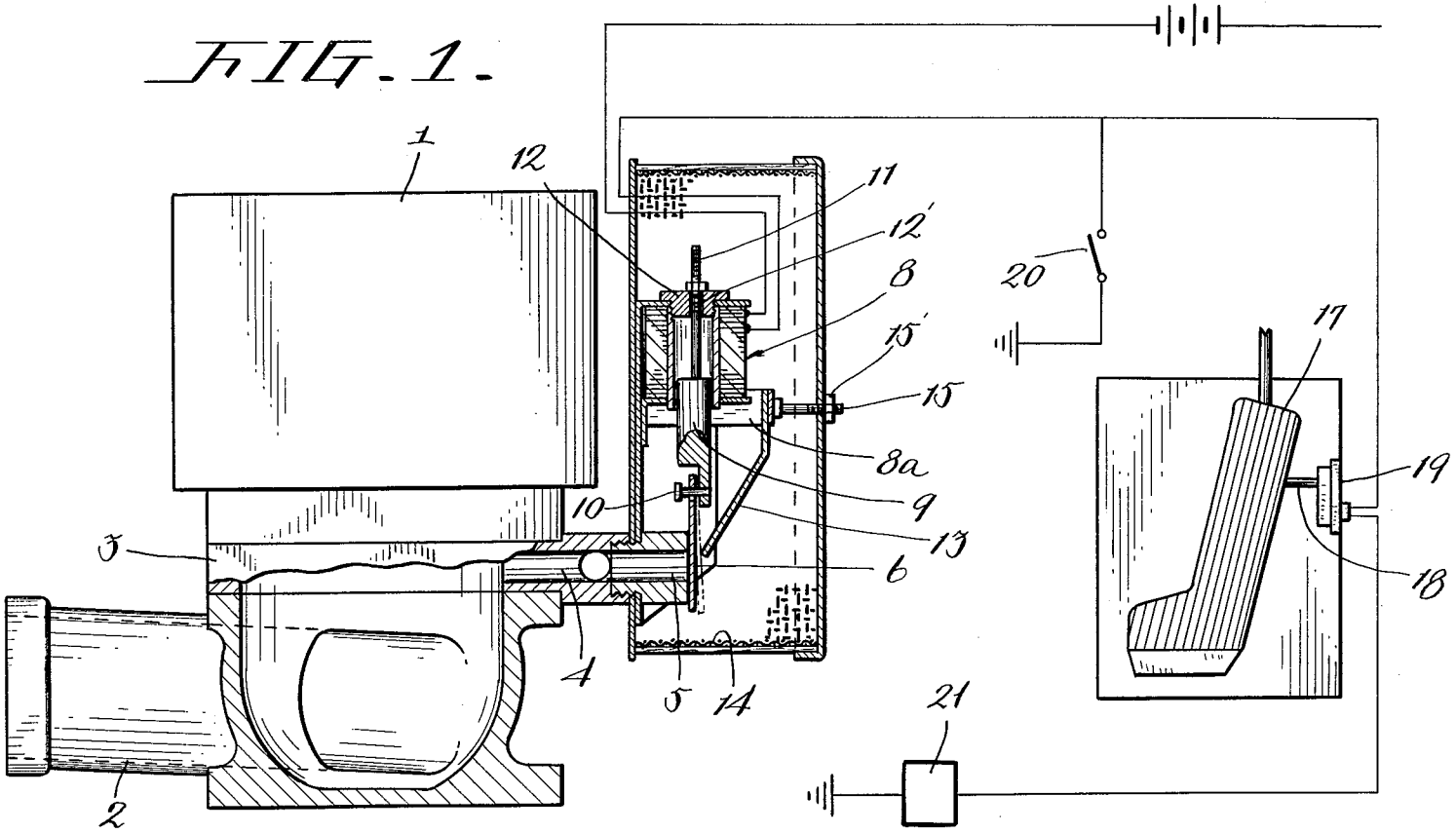
FIG. 1 is a schematic view in partial section of one preferred embodiment of a direct air cooling device for the combustion chamber of an automobile constructed in accordance with the principle of the present invention.
Figure 2:
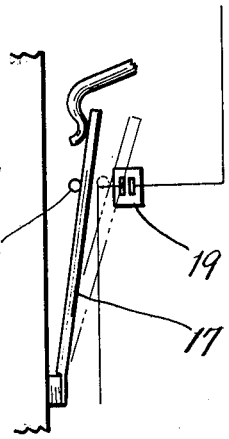
FIG. 2 is a side elevational view in vertical section of the accelerator pedal and its associated switch as shown in FIG. 1.
Figure 3:
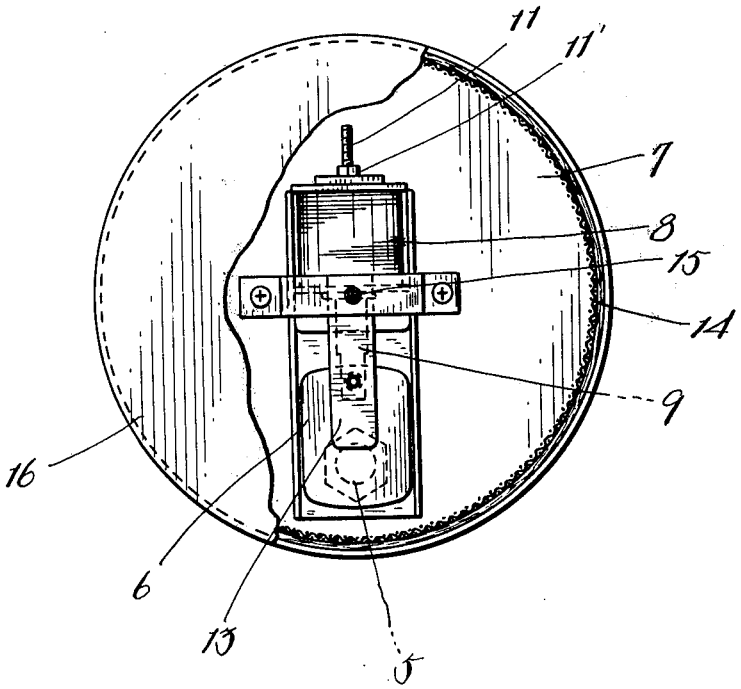
FIG. 3 is a front elevational view on an enlarged scale of said direct air cooling device as shown in FIG. 1 with a portion thereof being removed.

In FIG. 1, reference numeral 1 denotes the carburetor for the internal combustion engine in an automobile in which the direct air cooling device of the invention is incorporated. An air supply tube 2 is in communication at one end thereof with the carburetor 1 through a passage means 3, and at the other end thereof with the cylinder (not shown). The passage means 3 is provided with an air suction opening 4 for supplying external air to the air supply tube 2. The passage means 3 has an air suction port member 5 threadably connected thereto in communication with the air suction opening 4, and the port member 5 is normally engaged by a valve plate 6 which normally closes the air suction port member 5. The valve plate 6 is connected by means of a pivot pin 10 to the vertically movable iron core 9 of an electromagnet 8 mounted on a support block **8*a* which is secured to a mounting plate 7, which is in turn secured to the air suction port member 5. Thus, the valve plate 6 is movable between a first position in which the valve plate 6 closes the air suction port member 5, and a second position in which the valve plate opens the suction port member to external air as the valve plate moves downwardly and upwardly or pivots in the clockwise or counter-clockwise direction as seen in FIG. 1. A limit rod 11 extends upwardly from the iron core 9 and has the upper end thereof extending loosely through a through hole 12' formed in a transverse iron piece 12 on the electromagnet 8. A nut 11' is mounted on the extended upper end of the limit rod 11 to limit the downward movement of the iron core and limit rod assembly and accordingly, of the valve plate 6 connected to the assembly. A stop 13 is secured at one or the upper end to the electromagnet support block 8*a* to limit the outward movement of the valve plate 6 with respect to the air suction port member 5. A hollow cylindrical air cleaner or filter 14 formed of a screen mesh is secured at one end to the mounting plate 7 and surrounds the electromagnet assembly 8, 9, 11, 12 and the air suction port member 5 in a peripherally spaced relationship thereto. A circular cover 16 is secured to the other end of the cylindrical air cleaner 14 in the manner described below. A bolt 15 extends through the cover 16 into the electromagnet support block 8*a* and a nut 15' is fastened to the bolt 15 to thereby secure the cover 16 to the air cleaner 14**.

An accelerator pedal 17 is provided in the electrical control circuit in which the electromagnet 8 is incorporated and has a transverse rod 18 extending therefrom. A switch 19 is also provided in the electrical circuit so that when the accelerator pedal 17 is released from its depressing force, the rod 18 actuates the switch 19 to close the electrical circuit to thereby cause the iron core 9 and limit rod 11 to move upwardly so as to open the air suction port member 5; whereupon a substantial amount of external air is allowed to flow through the now open suction port member 5 into the combustion chamber of the vehicular internal combustion engine. An optional switch 20 is provided in the electrical circuit for optionally moving the valve plate 6 to open the suction port member 5 and a foot switch 21 is also provided in the electrical circuit adjacent to the clutch (not shown). When it is desired to stop the running automobile, since the driver first depresses the brake and then depresses the clutch after removing his foot from the foot switch 21, the foot switch 21 is deenergized whereupon the direct air cooling device of the invention ceases its operation to thereby prevent the engine from stopping.

The above-mentioned operational switch 20 is provided to operate the direct air cooling device of the invention as the driver desires regardless of the running speed of the automobile, independently of the switches 19 and 21. When the engine is operating, even if a clearance in the order of 5 mm is present between the air suction port member 5 and valve plate 6, the valve plate 6 can be sucked to the air suction port member 5 under the action of negative pressure generated in the air suction port member 5 as soon as the motor starts its rotation upon starting the automobile. The valve plate 6 can easily move upwardly under the action of current of 15 W applied to the electromagnet 8 to thereby open the suction port member 5. The thickness of the valve plate 6 and the weight of the iron core 9 are so selected that they are allowed to drop by gravity when the application of current to the electromagnet 8 is interrupted.

According to the present invention, the valve plate 6 is maintained in its sealing contact relationship to the air suction port member 5 under the action by the negative pressure of the air sucked into the port member 5 while the automobile is being driven and the valve plate is slidably moved upwardly when the automobile is driven at a reduced speed, to thereby open the air suction port member 5 whereupon a substantial amount of external air is directly sucked through the suction port member 5 into the combustion chamber of the engine. The sucked air rapidly cools the piston head and exhaust valve (not shown) to thereby prolong the service life of the engine, substantially save fuel consumption, substantially reduce blow-by and especially, ensure optimum performance of the engine brake.

While only one embodiment of the invention has been shown and described in detail, it will be understood that the same is for illustration purposes only, reference being had to the appended claims for determining the scope of the invention.

What is claimed is:

1. A direct air cooling device for a combustion chamber of an internal combustion engine in an automobile, comprising:

an air supply tube(2) having a first end thereof connected to a cylinder of said internal combustion engine;

passage means(3) connected between a carburetor of said internal combustion engine and a second end of said air supply tube(2);

said passage means(3) being provided with an air suction opening(4);

an air suction port member(5) connected to said passage means(3) and communicating with said air suction opening(4);

a solid, imperforate, flat valve plate(6) disposed adjacent to an open end of said air suction port member(5);

an electromagnet(8);

an iron core movable within and under the influence of said electromagnet(8);

said solid, imperforate, flat valve plate(6) being suspended from said iron core(9);

said solid, imperforate, flat valve plate(6) normally facing and bearing against said air suction port member(5) and closing said open end of said air suction port member(5);

said solid, imperforate, flat valve plate(6) being movable to uncover said open end of said air suction port member(5) under the influence of said electromagnet(8);

an air cleaner mounting plate(7) affixed to said air suction port member(5); and an air cleaner(14) connected to said air cleaner mounting plate(7) and surrounding said solid, imperforate, flat valve plate(6), said open end of said air suction port member(5), said electromagnet(8), said iron core(9) and a major portion of said air suction port member(5).

2. The direct air cooling device of claim 1, including:

a pivot pin loosely connecting said plate to said iron core with said plate being pivotal about a horizontal axis and being moveable transversely of its vertical path of movement by said electromagnet;

a stop member adjacent said plate and facing said open end;

said stop member serving to limit movement of said plate longitudinally from said open end.

3. The direct air cooling device of claim 1, including:

an electric control circuit for controlling said electromagnet and said plate;

a switch in said circuit; and foot operable means for operating said switch.

* * * * *